US009959993B2

(12) United States Patent
Wang

(10) Patent No.: US 9,959,993 B2
(45) Date of Patent: May 1, 2018

(54) KEY CONNECTING MODULE

(71) Applicant: Primax Electronics Ltd., Neihu, Taipei (TW)

(72) Inventor: Yi-Chen Wang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 40 days.

(21) Appl. No.: 14/992,889

(22) Filed: Jan. 11, 2016

(65) Prior Publication Data

US 2017/0148589 A1 May 25, 2017

(30) Foreign Application Priority Data

Nov. 20, 2015 (TW) ..... 104138516 A

(51) Int. Cl.
*H01H 9/26* (2006.01)
*H01H 13/72* (2006.01)
*H01H 13/7065* (2006.01)

(52) U.S. Cl.
CPC ... *H01H 13/7065* (2013.01); *H01H 2221/044* (2013.01); *H01H 2221/058* (2013.01)

(58) Field of Classification Search
CPC ..... H01H 13/7065; H01H 2221/058; H01H 2221/044; H01H 13/705
USPC ..... 200/5 A, 341, 344, 345, 517, 518, 520; 400/490
See application file for complete search history.

(56) References Cited

U.S. PATENT DOCUMENTS 8,878,085 B2 * 11/2014 Lin ..... G06F 3/0202 200/292
2006/0266629 A1 * 11/2006 Yu ..... H01H 13/705 200/5 A
2013/0048482 A1 * 2/2013 Saitou ..... H01H 13/06 200/341

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

The present invention relates to a key connecting module for triggering a switch circuit board, where the key connecting module includes a frame having a support structure, and a triggering assembly, and the triggering assembly is accommodated in the support structure and is moveable relative to the frame to trigger the switch circuit board. The triggering assembly includes a first combining part corresponding to a first keycap and a second combining part corresponding to a second keycap. When the key connecting module is connected to the first keycap, the first keycap is combined with the first combining part. When the key connecting module is connected to the second keycap, the second keycap is combined with the second combining part.

10 Claims, 8 Drawing Sheets

KEY CONNECTING MODULE

FIELD OF THE INVENTION

The present invention relates to a key connecting module, and in particular, to a key connecting module that can be connected to different types of keycaps, to form different types of keyboards.

BACKGROUND OF THE INVENTION

Common peripheral input apparatuses of a computer include a mouse, a keyboard, a trackball, and the like, where the keyboard can be used to directly enter text and symbols to the computer, and therefore draws great attention from users and input apparatus venders. Keyboards are classified into keyboards for desktop computers and keyboard modules for notebook computers.

Next, a structure of the keyboard for the desktop computer is described. Refer to FIG. 1, which is a schematic cross-sectional view of partial structure of a conventional keyboard. A conventional keyboard 1 includes a plurality of first keycaps 11 (where only one first keycap is shown in the figure), a frame 12, a plurality of elastic rubber bodies 13 (only one elastic rubber body is shown in the figure), a membrane switch circuit 14, and a bottom board 15, where the bottom board 15 may carry the plurality of first keycaps 11, the frame 12, the plurality of elastic rubber bodies 13, and the membrane switch circuit 14 thereon. The membrane switch circuit 14 is disposed on the bottom board 15 and has a plurality of key contacts (not shown in the figure). When a key contact of the membrane switch circuit 14 is triggered, the membrane switch circuit 14 outputs a corresponding key signal. The plurality of elastic rubber bodies 13 is disposed on the membrane switch circuit 14 and each elastic rubber body 13 corresponds to one first keycap 11. When the elastic rubber body 13 is pressed, the elastic rubber body 13 is deformed and presses the membrane switch circuit 14 to trigger the membrane switch circuit 14.

The frame 12 is disposed above the membrane switch circuit 14, and the frame 12 has a plurality of the support structures 121 (where only one support structure is shown in the figure) corresponding to the plurality of first keycaps 11, where each support structure 121 surrounds one elastic rubber body 13. A function of the plurality of the support structures 121 is to fix the plurality of first keycaps 11 thereon, and make the plurality of first keycaps 11 movable up and down relative to the frame 12. The first keycap 11 includes a contact part 111 and a connecting part 112, where the contact part 111 is a part exposed to an outer surface of the keyboard 1, and can be pressed by a user. The connecting part 112 and the contact part 111 are integrally formed, and the connecting part 112 extends downwards to be connected to the corresponding support structure 121. Because the support structure 121 in the frame 12 is shaped to surround the elastic rubber body 13 and is like a crater, the keyboard for the desktop computer is also commonly known as a crater-architecture keyboard.

When a user presses the contact part 111 of the first keycap 11, the connecting part 112 is stressed and moves downwards relative to the frame 12 and presses the corresponding elastic rubber body 13; in this case, the elastic rubber body 13 is deformed and presses the membrane switch circuit 14 to trigger the key contact of the membrane switch circuit 14, so that the membrane switch circuit 14 outputs a corresponding key signal. When the user stops pressing the contact part 111, the connecting part 112 is no longer stressed and stops pressing the elastic rubber body 13; therefore, the elastic rubber body 13 is restored due to its elasticity, and provides upward resilience at the same time. Therefore, the first keycap 11 is pushed back to a position at which it is located before being pressed.

Next, a structure of the keyboard module for the notebook computer is described. Refer to FIG. 2, which is a schematic cross-sectional view of partial structure of a conventional keyboard module. A keyboard module 2 includes a plurality of second keycaps 21 (where only one second keycap is shown in the figure), a plurality of scissors-type connecting assemblies 22 (where only one scissors-type connecting assembly is shown in the figure), a plurality of elastic rubber bodies 23 (where only one elastic rubber body is shown in the figure), a membrane switch circuit 24, and a bottom board 25. The bottom board 25 may carry the plurality of second keycaps 21, the plurality of scissors-type connecting assemblies 22, the plurality of elastic rubber bodies 23, and the membrane switch circuit 24 thereon, and the bottom board 25 is connected to the plurality of second keycaps 21 by using the plurality of scissors-type connecting assemblies 22. In other words, the scissors-type connecting assemblies 22 are separately connected to the bottom board 25 and the corresponding second keycaps 21.

The membrane switch circuit 24 is disposed on the bottom board 25 and has a plurality of key contacts (not shown in the figure). When a key contact of the membrane switch circuit 14 is triggered, the membrane switch circuit 24 outputs a corresponding key signal. The plurality of elastic rubber bodies 23 is disposed on the membrane switch circuit 24 and each elastic rubber body 23 corresponds to one second keycap 21. When the elastic rubber body 23 is pressed, the elastic rubber body 23 is deformed and presses the membrane switch circuit 24 to trigger the membrane switch circuit 24. The scissors-type connecting assembly 22 is located between and separately connected to the bottom board 25 and the second keycap 21, and the scissors-type connecting assembly 22 is moveable relative to the bottom board 25, so that the second keycap 21 moves up and down. Each scissors-type connecting assembly 22 surrounds a corresponding elastic rubber body 23. Because a shape and a motion manner of the scissors-type connecting assembly 22 are similar to scissors, the keyboard module for the notebook computer is commonly known as a scissors-architecture keyboard.

An operation of the second keycap 21 when the second keycap 21 is pressed is similar to the aforementioned operation of the first keycap 11 when the first keycap 11 is pressed. When a user presses the second keycap 21, the second keycap 21 is stressed and pushes the scissors-type connecting assembly 22 to move; therefore, the second keycap 21 may move downwards relative to the bottom board 25 and press the corresponding elastic rubber body 23. In this case, the elastic rubber body 23 is deformed and presses the membrane switch circuit 24 to trigger the key contact of the membrane switch circuit 24, so that the membrane switch circuit 24 outputs a corresponding key signal. When the user stops pressing the second keycap 21, the second keycap 21 is no longer stressed and stops pressing the elastic rubber body 23; therefore, the elastic rubber body 23 is restored due to its elasticity, and provides upward resilience at the same time. Therefore, the second keycap 21 is pushed back to a position at which it is located before being pressed.

The foregoing two types of keyboards are used according to different needs, for example, the conventional keyboard 1 has relatively low costs, while the appearance of the second keycap 21 of the conventional keyboard module 2 is relatively light and thin, and a user may choose a suitable keyboard according to different needs. However, some users favor the second keycap 21 that is light and thin, and also hope that costs of the keyboard using the second keycaps 21 can be reduced. This is a problem that keyboard manufacturers want to resolve.

SUMMARY OF THE INVENTION

An objective of the present invention is to provide a key connecting module applicable to a plurality of different keycaps and a keyboard having the key connecting module.

In a preferred embodiment, the present invention provides a key connecting module and a keyboard having the key connecting module. The key connecting module is disposed on a bottom board and is used to trigger a switch circuit board. The key connecting module includes a frame and a triggering assembly. The frame is disposed above the switch circuit board, and the frame has a support structure. The triggering assembly is accommodated in the support structure, is moveable relative to the frame so as to be combined with a first keycap or a second keycap, and is pushed by the first keycap or the second keycap to trigger the switch circuit board, where when the key connecting module is connected to the first keycap, the first keycap partially extends into the triggering assembly and is combined with a first combining part of the triggering assembly; and when the key connecting module is connected to the second keycap, the second keycap partially extends into the triggering assembly and is combined with a second combining part of the triggering assembly.

In short, the key connecting module of the present invention is disposed between a switch circuit board and keycaps, and a triggering assembly of the key connecting module has multiple combining parts that fit different keycap shapes, where a shape of a first combining part of a connecting piece of the triggering assembly is complementary to a shape of a first keycap combining part, and a shape of a second combining part of the connecting piece is complementary to a shape of a second keycap combining part. Therefore, keycaps in different shapes may be combined with the triggering assembly to separately form keyboards in different shapes. In addition, as compared with a scissors-architecture keyboard, the key connecting module in the present invention has a simpler structure and a process of assembling the key connecting module with different keycaps is simpler; therefore, the keyboard formed by using the key connecting module in the present invention has lower costs than the scissors-architecture keyboard, and can provide an appearance of the scissors-architecture keyboard for the user at relatively low costs, thereby satisfying a need of the user.

DETAILED DESCRIPTION OF THE PREFERRED EMBODIMENT

Figure 1:
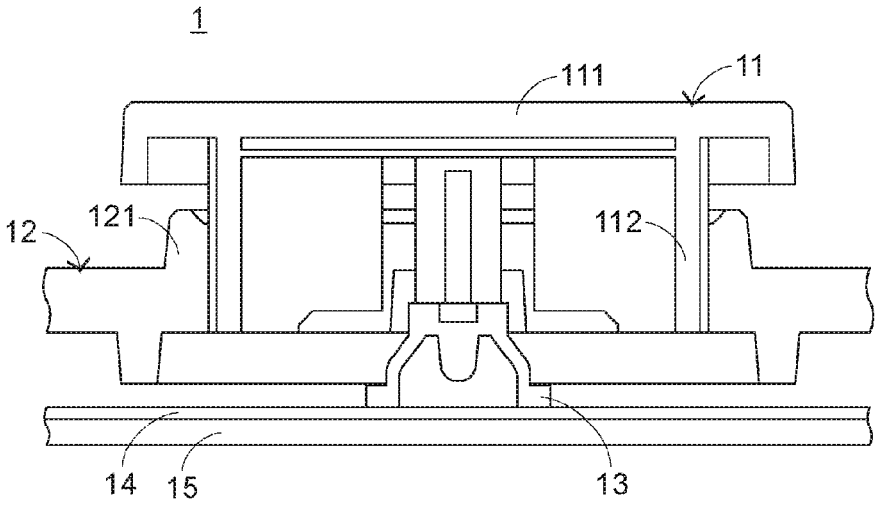
FIG. 1 (Prior art)
FIG. 1 is a schematic cross-sectional view of partial structure of a conventional keyboard.
Figure 2:
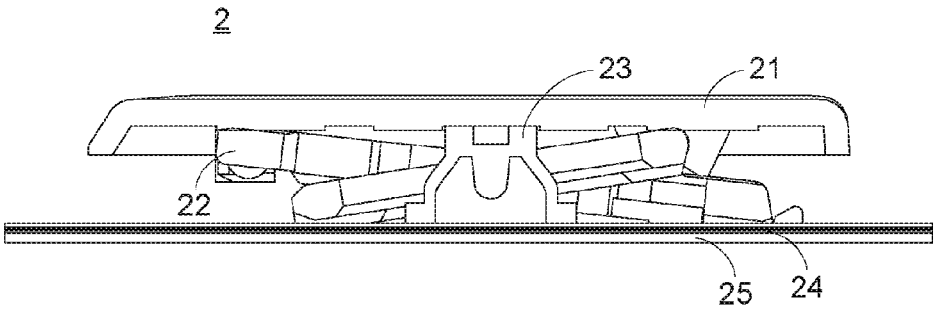
FIG. 2 (Prior art)
FIG. 2 is a schematic cross-sectional view of partial structure of a conventional keyboard module.
Figure 3:
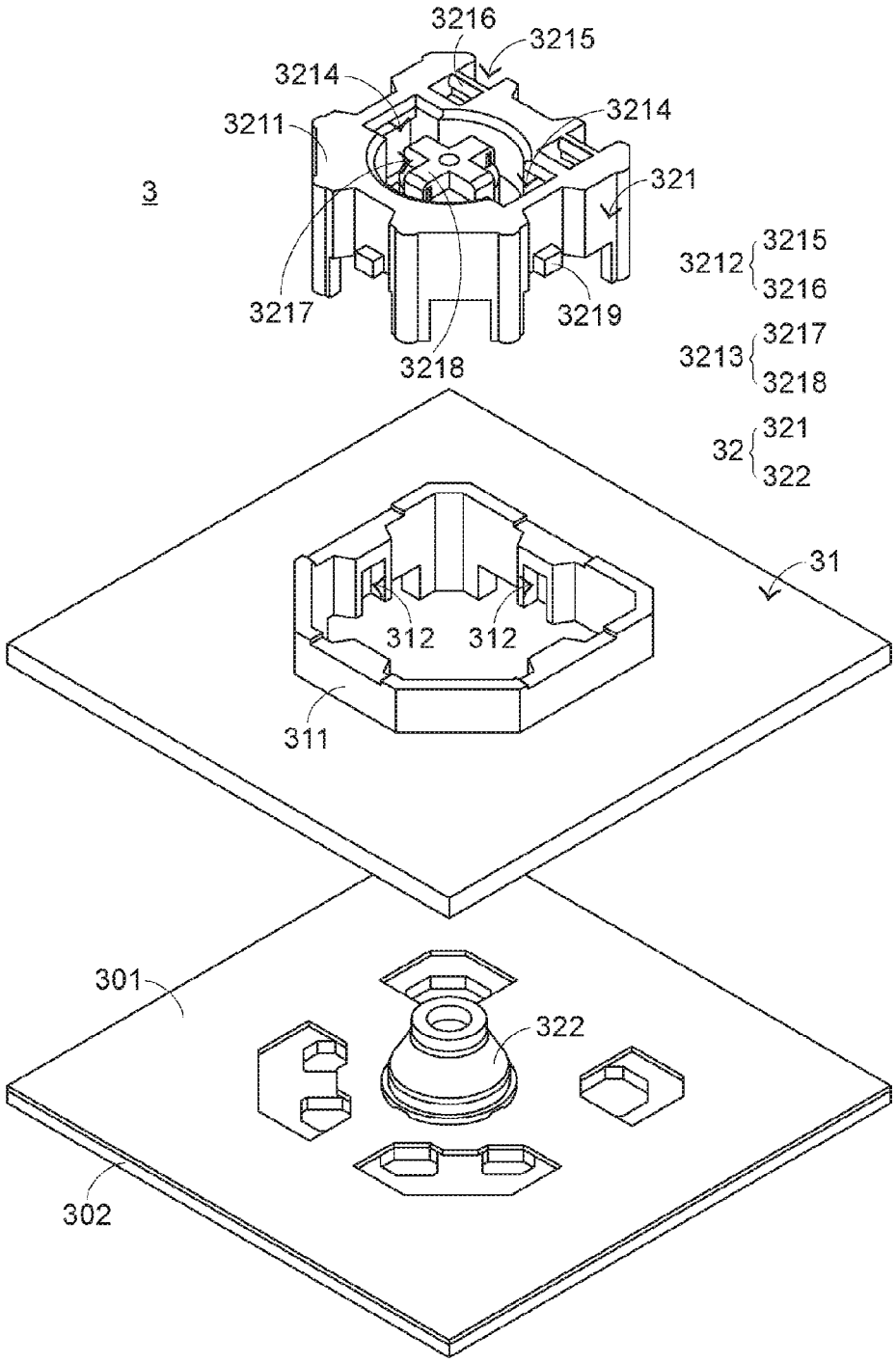
FIG. 3 is an exploded schematic structural view of a preferred embodiment of a key connecting module according to the present invention.
Figure 4:
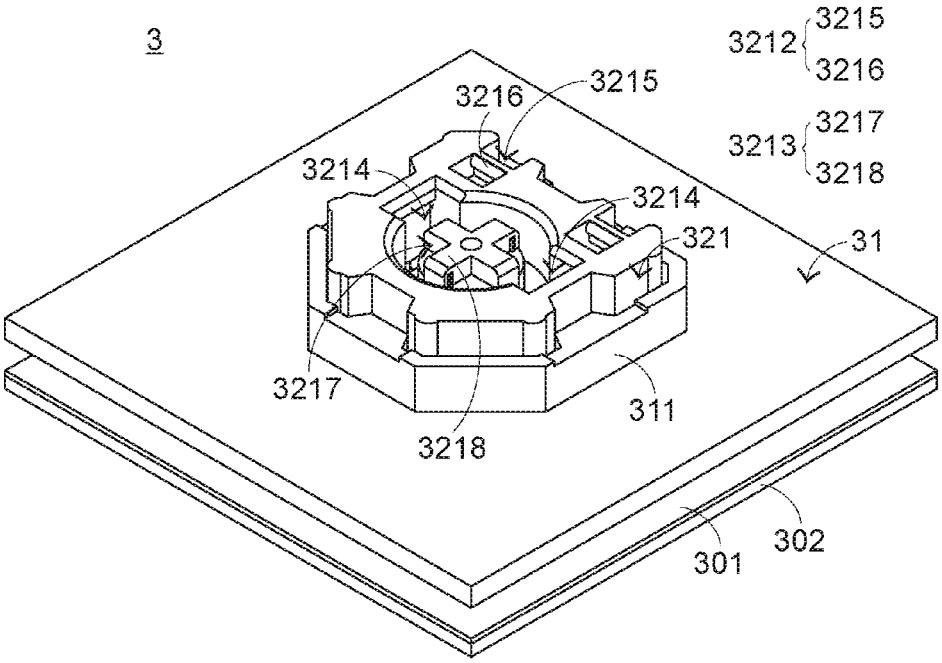
FIG. 4 is a schematic structural view of a preferred embodiment of a key connecting module according to the present invention.

In view of the problem in the prior art, the present invention provides a key connecting module that can be shared by multiple types of keycaps, so that different keyboards can be formed, thereby resolving the problem in the prior art. Referring to FIG. 3 and FIG. 4 together, FIG. 3 is an exploded schematic structural view of a preferred embodiment of a key connecting module according to the present invention, and FIG. 4 is a schematic structural view of a preferred embodiment of a key connecting module according to the present invention. FIG. 3 and FIG. 4 show a key connecting module 3, a switch circuit board 301, and a bottom board 302, where the key connecting module 3 is disposed on the switch circuit board 301 and the bottom board 302, and the key connecting module 3 includes a frame 31 and a plurality of triggering assemblies 32 (where only one triggering assembly is shown in the figure). The frame 31 is disposed above the switch circuit board 301, and the frame 31 includes a plurality of support structures 311 (where only one support structure is shown in the figure) and a plurality of limiting grooves 312, where the plurality of limiting grooves 312 is separately provided on inner surfaces of the plurality of support structures 311. The triggering assembly 32 is accommodated in the corresponding support structure 311, and is moveable relative to the frame 31. A function of the triggering assembly 32 is to be combined with keycaps in different shapes, and to be pushed by the keycap to trigger the switch circuit board 301.

Figure 5:
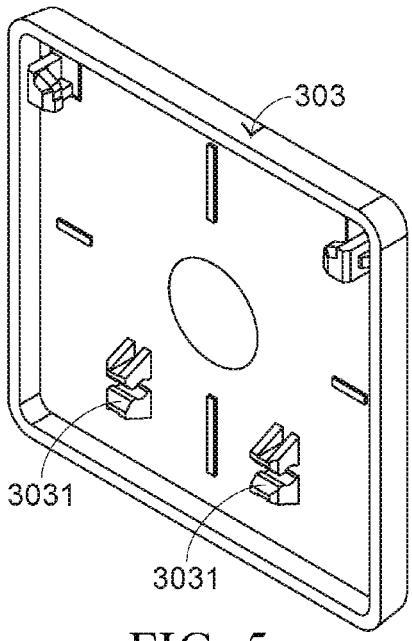
FIG. 5 is a schematic structural view of a preferred embodiment of a first keycap connected to a key connecting module according to the present invention.
Figure 6:
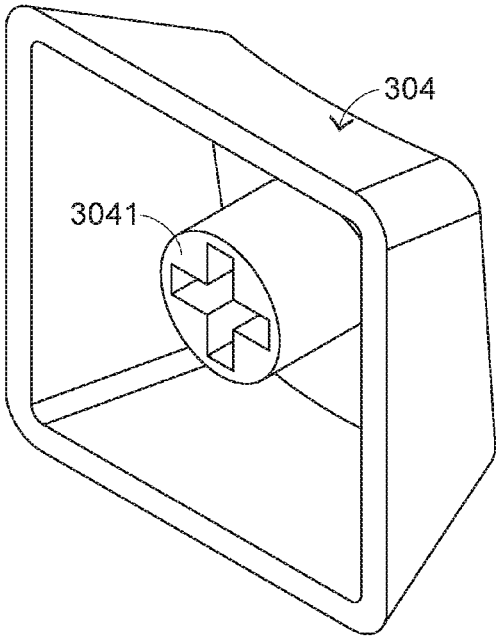
FIG. 6 is a schematic structural view of a preferred embodiment of a second keycap connected to a key connecting module according to the present invention.
Figure 7:
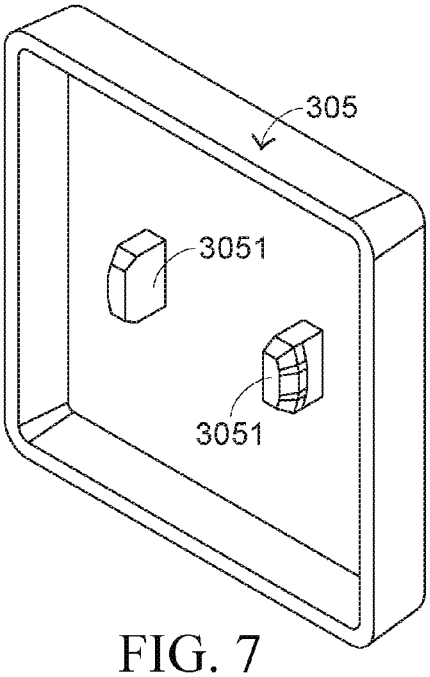
FIG. 7 is a schematic structural view of a preferred embodiment of a third keycap connected to a key connecting module according to the present invention.

In FIG. 3, the triggering assembly 32 includes a connecting piece 321 and a triggering piece 322, and the connecting piece 321 is fixed to the corresponding support structure 311, so that the keycap combined with the connecting piece 321 extends into a top end 3211 of the connecting piece 321 and is combined with the connecting piece 321. The triggering piece 322 is located below the connecting piece 321, where one end of the triggering piece 322 is in contact with the connecting piece 321, and the other end of the triggering piece 322 is in contact with the switch circuit board 301. A function of the triggering piece 322 is to be pushed by the keycap combined with the connecting piece 321, so as to trigger the switch circuit board 301. The connecting piece 321 includes a first combining part 3212, a second combining part 3213, and a third combining part 3214. The first combining part 3212 corresponds to a first keycap 303, as shown in FIG. 5. The second combining part 3213 corresponds to a second keycap 304, as shown in FIG. 6. The third combining part 3214 corresponds to a third keycap 305, as shown in FIG. 7. In this preferred embodiment, the triggering piece 322 is an elastic rubber body.

In FIG. 5, the first keycap 303 has a first keycap combining part 3031, and the first keycap combining part 3031 extends out of an inner surface of the first keycap 303. In FIG. 6, the second keycap 304 has a second keycap combining part 3041, and the second keycap combining part 3041 extends out of an inner surface of the second keycap 304. In FIG. 7, a third keycap combining part 3051 extends out of an inner surface of the third keycap 305. In this preferred embodiment, the first keycap combining part 3031 is a fixed hook, and the first keycap 303 is a keycap for a scissors-architecture keyboard. The second keycap combining part 3041 has a fixed cylinder, and the fixed cylinder has a cross-shaped concave part therein. The second keycap 304 is a keycap for a crater-architecture keyboard. The third keycap combining part 3051 is a fixed clamping hook, and the third keycap 305 is a keycap for a mechanical keyboard.

Referring to FIG. 3 and FIG. 4 again, the first combining part 3212 is disposed on one side of the top end 3211 of the connecting piece 321, and is complementary to the first keycap combining part 3031. A function of the first combining part 3212 is to accommodate the first keycap combining part 3031, so as to be connected to the first keycap combining part 301. The first combining part 3212 includes a first slot 3215 and a fixed shaft 3216, where the first slot 3215 is provided on one side of the top end 3211 of the connecting piece 321, and can accommodate the first keycap combining part 3031. The fixed shaft 3216 is disposed above the first slot 3215, and a function of the fixed shaft 3216 is to be connected to the first keycap combining part 3031, where shapes of the first slot 3215 and the fixed shaft 3216 are complementary to a shape of the first keycap combining part 3031.

In FIG. 3 and FIG. 4, the second combining part 3213 is disposed in the center of the top end 3211 of the connecting piece 321, and is complementary to the second keycap combining part 3041. A function of the second combining part 3213 is to accommodate the second keycap combining part 3041 and to be connected to the second keycap combining part 3041. The second combining part 3213 includes a second slot 3217 and a fixed protruding part 3218, where the second slot 3217 is provided in the center of the top end 3211 of the connecting piece 321, and can accommodate the second keycap combining part 3041. The fixed protruding part 3218 is provided in the second slot 3217, and a function of the fixed protruding part 3218 is to be connected to the second keycap combining part 3041 and to fix the second keycap combining part 3041 to the second slot 3217. The fixed protruding part 3218 is a cross-shaped projection, and shapes of the second slot 3217 and the fixed protruding part 3218 are complementary to a shape of the second keycap combining part 3041.

In another aspect, the third combining part 3214 is disposed in the center of the top end 3211 of the connecting piece 321, and is located on two sides of the second combining part 3213. A function of the third combining part 3214 is to accommodate the third keycap combining part 3051 and to clamp the third keycap combining part 3051. In this preferred embodiment, a shape of the third combining part 3214 is a groove complementary to a shape of the second keycap combining part 3051.

In addition, the connecting piece 321 further includes a plurality of fixed projections 3219 arranged around the connecting piece 321, and each fixed projection 3219 corresponds to one limiting groove 312. A function of the limiting groove 312 is to accommodate the corresponding fixed projection 3219 and to prevent the fixed projection 3219 from separating from the frame 31. In this preferred embodiment, the first combining part 3212, the second combining part 3213, the third combining part 3214, and the plurality of fixed projections 3219 are all integrally formed with the connecting piece 321.

Figure 8:
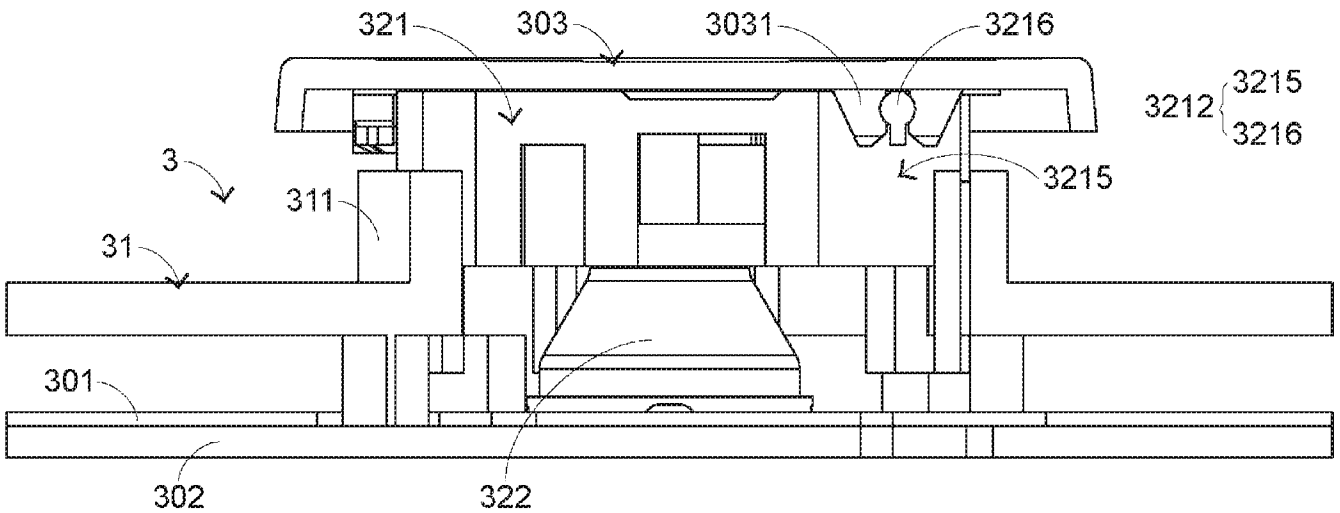
FIG. 8 is a schematic structural sectional view of a preferred embodiment of a key connecting module and a first keycap according to the present invention.

Next, structures when the key connecting module 3 in the present invention is separately combined with different keycaps are described. Referring to FIG. 3, FIG. 4, FIG. 5, and FIG. 8 together, FIG. 8 is a schematic structural sectional view of a preferred embodiment of a key connecting module and a first keycap according to the present invention. FIG. 8 shows a case in which the first keycap 303 is combined with the connecting piece 321, where the first keycap combining part 3031 extends into the first slot 3215 and is connected to the fixed shaft 3216, to complete combination of the first keycap 303 and the connecting piece 321. When a user presses the first keycap 303, the first keycap 303 is stressed and moves downwards to push the connecting piece 321, so that the connecting piece 321 moves downwards relative to the frame 31 and presses the corresponding triggering piece 322. In this case, the triggering piece 322 is deformed and presses the switch circuit board 301 to trigger a key contact of the switch circuit board 301, and therefore, the switch circuit board 301 outputs a corresponding key signal. During a process in which the connecting piece 321 is pushed, the plurality of fixed projections 3219 separately moves up and down in corresponding limiting grooves 312.

When the user stops pressing the first keycap 303, the second keycap 321 is no longer stressed and stops pressing the triggering piece 322; therefore, the triggering piece 322 is restored due to its elasticity, and provides upward resilience at the same time. Therefore, the first keycap 303 is pushed back to a position at which it is located before being pressed.

Figure 9:
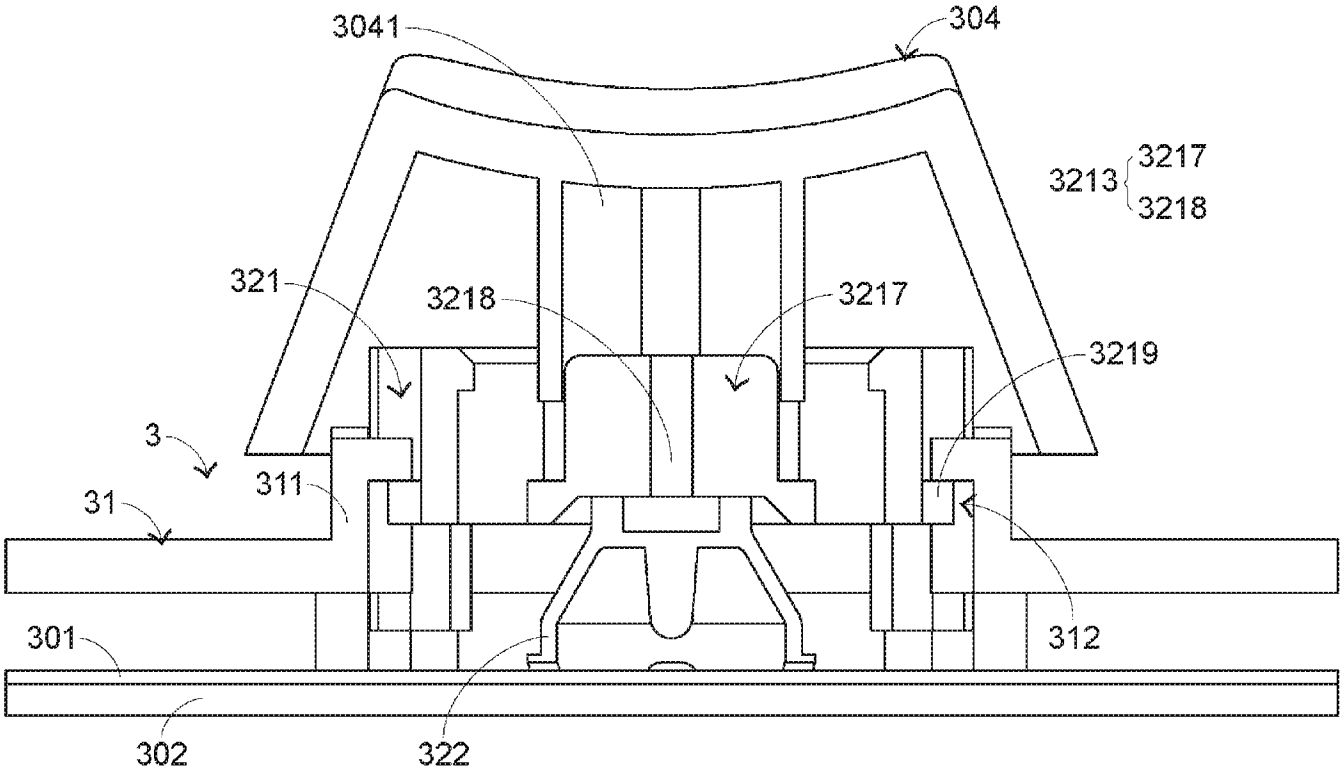
FIG. 9 is a schematic structural sectional view of a preferred embodiment of a key connecting module and a second keycap according to the present invention.

Next, referring to FIG. 3, FIG. 4, FIG. 6, and FIG. 9 together, FIG. 9 is a schematic structural sectional view of a preferred embodiment of a key connecting module and a second keycap according to the present invention. FIG. 9 shows a case in which the second keycap 304 is combined with the connecting piece 321, where the second keycap combining part 3041 extends into the second slot 3217 and is clamped and fixed with the fixed protruding part 3218, to complete combination of the second keycap 304 and the connecting piece 321. An operation of the second keycap 304 when the second keycap 304 is pressed is similar to the foregoing operation of the first keycap 303 when the first keycap 303 is pressed, and details are not described again.

Figure 10:
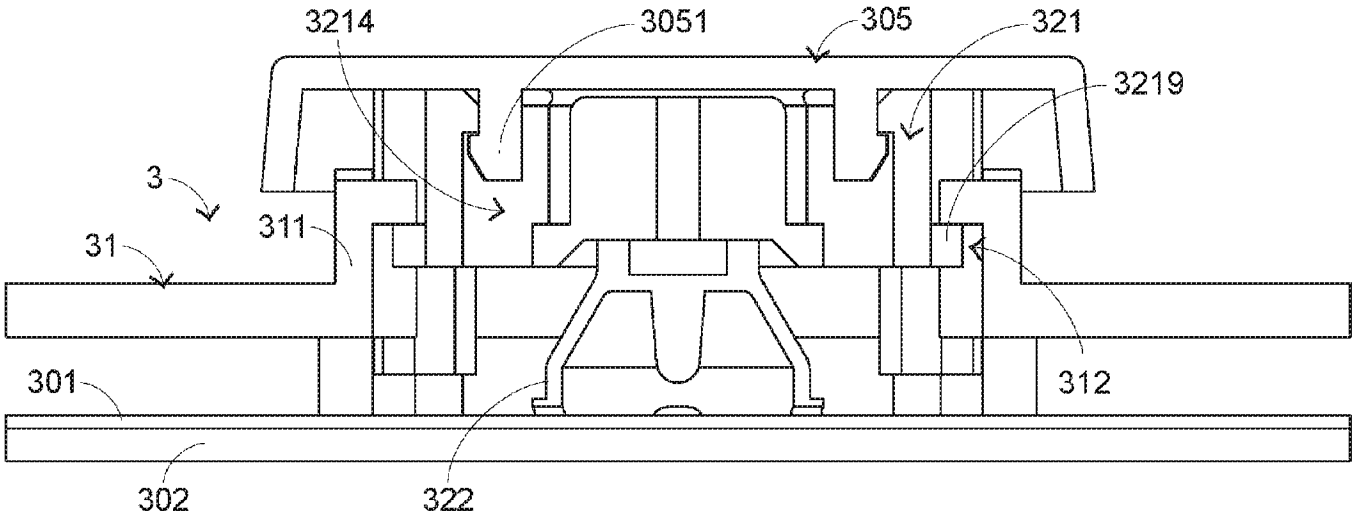
FIG. 10 is a schematic structural sectional view of a preferred embodiment of a key connecting module and a third keycap according to the present invention.
Figure 11:
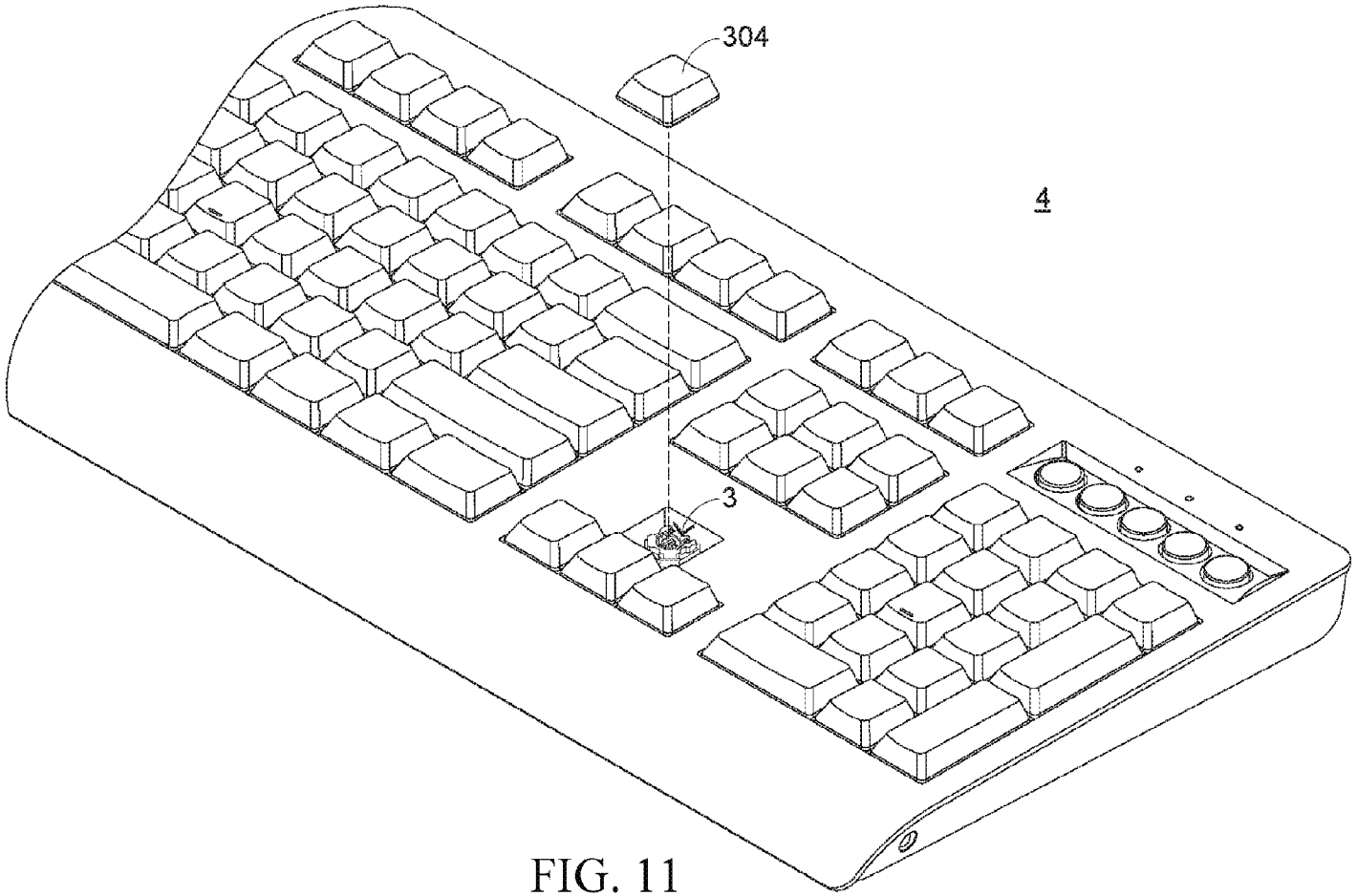
FIG. 11 is a schematic structural view of a keyboard that is formed by using a key connecting module and a second keycap in a preferred embodiment according to the present invention.

Referring to FIG. 3, FIG. 4, FIG. 7, and FIG. 10 together, FIG. 10 is a schematic structural sectional view of a preferred embodiment of a key connecting module and a third keycap according to the present invention. FIG. 10 shows a case in which the third keycap 305 is combined with the connecting piece 321, where the third keycap combining part 3051 extends into the third combining part 3214 that is groove-shaped, and is clamped and fixed with the third combining part 3214, to complete combination of the third keycap 305 and the connecting piece 321. An operation of the third keycap 305 when the third keycap 305 is pressed is similar to the foregoing operation of the first keycap 303 when the first keycap 303 is pressed, and therefore, details are not described again. In addition, in the present invention, a keyboard 4 formed by combing a key connecting module 3, keycaps, a switch circuit board, and a bottom board is shown in FIG. 11, where the keycaps are the foregoing second keycaps 304.

Two points need to be particularly noted: First, in preferred operations, before various keycaps are combined with the key connecting module 3, an adhesive may be disposed between the keycaps and the connecting piece 321, to strengthen the combination between the keycaps and the connecting piece 321, thereby preventing the keycaps from falling off. Second, because keycaps for different types of keyboards have different movement strokes (that is, movement distances of keycaps after being pressed), for example, a stroke of a keycap for a scissors-architecture keyboard is shorter than those of the other two types of keycaps, lengths of the plurality of limiting grooves 312 on the frame 31 may be shortened, to shorten the movement stroke of the keycap. Therefore, the keyboard formed by combining the first keycap 303 and the key connecting module 3 can provide a pressing feel similar to that of the scissors-architecture keyboard. In other words, for the key connecting module in the present invention, a movement stroke of a keycap may be controlled by adjusting the lengths of the plurality of limiting grooves.

It can be known according to the foregoing descriptions that, the key connecting module of the present invention is disposed between a switch circuit board and keycaps, and a triggering assembly of the key connecting module has multiple combining parts that fit different keycap shapes, where a shape of a first combining part of a connecting piece of the triggering assembly is complementary to a shape of a first keycap combining part, and a shape of a second combining part of the connecting piece is complementary to a shape of a second keycap combining part. Therefore, keycaps in different shapes may be combined with the triggering assembly to separately form keyboards in different shapes. In addition, as compared with a scissors-architecture keyboard, the key connecting module in the present invention has a simpler structure and a process of assembling the key connecting module with different keycaps is simpler; therefore, the keyboard formed by using the key connecting module in the present invention has lower costs than the scissors-architecture keyboard, and can provide an appearance of the scissors-architecture keyboard for the user at relatively low costs, thereby satisfying a need of the user.

The foregoing descriptions are merely preferred embodiments of the present invention, but are not intended to limit the application scope of the present invention. Any other equivalent variation or modification made without departing from the spirit disclosed in the present invention shall fall within the application scope of the present invention.

What is claimed is:

1. A key connecting module, disposed on a bottom board and used to trigger a switch circuit board, wherein the key connecting module comprises:

a frame, disposed above the switch circuit board and having a support structure; and a triggering assembly that is accommodated in the support structure, is moveable relative to the frame so as to be combined with a first keycap or a second keycap, and is pushed by the first keycap or the second keycap to trigger the switch circuit board, wherein the first keycap and the second keycap have different shapes and when the key connecting module is connected to the first keycap, the first keycap partially extends into the triggering assembly and is combined with a first combining part of the triggering assembly, wherein the first combining part is complementary to a first keycap combining part of the first keycap; and when the key connecting module is connected to the second keycap, the second keycap partially extends into the triggering assembly and is combined with a second combining part of the triggering assembly, wherein the second combining part is complementary to a second keycap combining part of the second keycap, wherein the triggering assembly comprises:

a connecting piece, fixed to the support structure, so that the first keycap and the second keycap separately extend into a top end of the connecting piece and are combined with the connecting piece; and a triggering piece, located below the connecting piece, wherein one end of the triggering piece is in contact with the connecting piece, and the other end of the triggering piece is in contact with the switch circuit board, so that the triggering piece is pushed by the first keycap or the second keycap to trigger the switch circuit board.

2. The key connecting module according to claim 1, wherein the first combining part is disposed on one side of the top end of the connecting piece to accommodate the first keycap combining part, so as to be connected to the first keycap combining part; and the second combining part is disposed in the center of the top end of the connecting piece to accommodate the second keycap combining part, so as to be connected to the second keycap combining part.

3. The key connecting module according to claim 2, wherein the first combining part comprises:

a first slot, provided on the side of the top end of the connecting piece, to accommodate the first keycap combining part; and a fixed shaft, disposed above the first slot, to be connected to the first keycap combining part.

4. The key connecting module according to claim 3, wherein the first keycap combining part is a fixed hook extending out of an inner surface of the first keycap, and shapes of the first slot and the fixed shaft are complementary to a shape of the first keycap combining part.

5. The key connecting module according to claim 2, wherein the second combining part comprises:

a second slot, disposed in the center of the top end of the connecting piece, to accommodate the second keycap combining part; and a fixed protruding part, disposed in the second slot, so as to be connected to the second keycap combining part and fix the second keycap combining part to the second slot.

6. The key connecting module according to claim 5, wherein the second keycap combining part is a fixed cylinder extending out of an inner surface of the second keycap, the fixed cylinder has a cross-shaped concave part therein, and shapes of the second slot and the fixed protruding part are complementary to a shape of the second keycap combining part.

7. The key connecting module according to claim 2, wherein the second combining part is disposed in the center of the top end of the connecting piece, to accommodate the second keycap combining part and clamp the second keycap combining part.

8. The key connecting module according to claim 7, wherein the second keycap combining part is a fixed clamping hook extending out of an inner surface of the second keycap, and a shape of the second combining part is a groove having a shape complementary to a shape of the second keycap combining part.

9. The key connecting module according to claim 1, wherein the connecting piece has a plurality of fixed projections arranged around the connecting piece, and the frame further comprises a plurality of limiting grooves provided on an inner surface of the support structure; each of the limiting grooves corresponds to one of the fixed projections, and the limiting groove is used to accommodate the corresponding fixed projection and prevent the fixed projection from separating from the frame, wherein the plurality of fixed projections moves in the plurality of limiting grooves when the connecting piece is pushed.

10. A keyboard having the key connecting module according to claim 1.

* * * * *